US010472704B2

(12) United States Patent
Hillskog et al.

(10) Patent No.: US 10,472,704 B2
(45) Date of Patent: Nov. 12, 2019

(54) COLD WORK TOOL STEEL

(71) Applicant: UDDEHOLMS AB, Hagfors (SE)

(72) Inventors: Thomas Hillskog, Karlstad (SE); Kjell Bengtsson, Råda (SE); Petter Damm, Karlstad (SE); Annika Engström Svensson, Filipstad (SE); Rikard Robertsson, Hagfors (SE); Kristoffer Steiner, Molkom (SE); Amanda Forsberg, Filipstad (SE); Magnus Tidesten, Hagfors (SE); Pär Emanuelsson, Sunne (SE)

(73) Assignee: UDDEHOLMS AB, Hagfors (SE)

( * ) Notice: Subject to any disclaimer, the term of this patent is extended or adjusted under 35 U.S.C. 154(b) by 278 days.

(21) Appl. No.: 15/302,457

(22) PCT Filed: Apr. 10, 2015

(86) PCT No.: PCT/SE2015/050428
§ 371 (c)(1),
(2) Date: Oct. 6, 2016

(87) PCT Pub. No.: WO2015/160302
PCT Pub. Date: Oct. 22, 2015

(65) Prior Publication Data

US 2017/0016099 A1 Jan. 19, 2017

(30) Foreign Application Priority Data

Apr. 14, 2014 (EP) ..... 14164524

(51) Int. Cl.

| | |
|---|---|
| ***C22C 38/36*** | (2006.01) |
| ***C22C 38/02*** | (2006.01) |
| ***C22C 38/04*** | (2006.01) |
| ***C22C 38/12*** | (2006.01) |
| ***C22C 38/22*** | (2006.01) |
| ***C22C 38/24*** | (2006.01) |
| ***C22C 33/02*** | (2006.01) |
| ***C21D 9/00*** | (2006.01) |

(52) U.S. Cl.
CPC ..... *C22C 38/36* (2013.01); *C21D 9/0068* (2013.01); *C22C 33/0278* (2013.01); *C22C 38/02* (2013.01); *C22C 38/04* (2013.01); *C22C 38/12* (2013.01); *C22C 38/22* (2013.01); *C22C 38/24* (2013.01)

(58) Field of Classification Search
None
See application file for complete search history.

(56) References Cited

U.S. PATENT DOCUMENTS

| | | | | |
|---|---|---|---|---|
| 4,249,945 | A | 2/1981 | Haswell et al. | |
| 4,863,515 | A * | 9/1989 | Roberts | C22C 38/36 75/238 |
| 5,225,007 | A * | 7/1993 | Hattori | B21B 27/00 148/324 |
| 5,522,914 | A | 6/1996 | Stasko et al. | |
| 5,578,773 | A | 11/1996 | Wisell | |
| 5,900,560 | A | 5/1999 | Pinnow et al. | |
| 6,057,045 | A * | 5/2000 | Wojcieszynski | C22C 33/0285 428/546 |
| 6,482,354 | B1 * | 11/2002 | Wert | C22C 38/36 420/10 |
| 6,818,040 | B1 * | 11/2004 | Sandberg | C22C 38/36 75/238 |
| 6,837,945 | B1 * | 1/2005 | Sandberg | C22C 38/36 148/321 |
| 2003/0068248 | A1 * | 4/2003 | Liebfahrt | C22C 38/36 420/10 |
| 2004/0103959 | A1 * | 6/2004 | Sandberg | C22C 38/36 148/324 |
| 2008/0078475 | A1 | 4/2008 | Kajinic et al. | |
| 2017/0233854 | A1 * | 8/2017 | Damm | C22C 38/44 420/101 |

FOREIGN PATENT DOCUMENTS

| | | | |
|---|---|---|---|
| EP | 0076027 | A2 * | 4/1983 |
| EP | 0275475 | A1 | 7/1988 |
| EP | 0467857 | A1 | 1/1992 |
| EP | 0515018 | A1 | 11/1992 |
| EP | 0773305 | A1 | 5/1997 |
| EP | 1382704 | A1 | 1/2004 |
| EP | 2662166 | A1 | 11/2013 |
| JP | S62124259 | A | 6/1987 |
| JP | H03254304 | A | 11/1991 |
| JP | H04182013 | A | 6/1992 |
| JP | H107188859 | A | 7/1995 |
| JP | 2001234288 | A | 8/2001 |
| JP | 2001294985 | A | 10/2001 |
| JP | 2002161332 | A | 6/2002 |
| JP | 2003049248 | A | 2/2003 |
| JP | 2005028453 | A | 2/2005 |

(Continued)

OTHER PUBLICATIONS

English translation of EP 1382704, Jan. 2004; 9 pages.*
Japanese Office Action dated Sep. 25, 2017, for Japanese Patent Application No. 2016-560587.
Extended European Search Report dated May 2, 2017, for European Patent Application No. 15780304.
Extended European Search Report dated Oct. 17, 2014, for European Patent Application No. 14164524.2.
Japanese Office Action dated Feb. 6, 2018, for Japanese Patent Application No. 2016-560587.
International Search Report and Written Opinion dated Jun. 23, 2015, for International Patent Application No. PCT/SE2015/050428.

(Continued)

*Primary Examiner* — Helene Klemanski
(74) *Attorney, Agent, or Firm* — Karceski IP Law, PLLC

(57) ABSTRACT

The invention relates cold work tool steel. The steel includes the following main components (in wt. %): C 2.2-2.4, Si 0.1-0.55, Mn 0.2-0.8, Cr 4.1-5.1, Mo 3.1-4.5, V 7.2-8.5, balance optional elements, iron and impurities.

10 Claims, No Drawings

(56) References Cited

FOREIGN PATENT DOCUMENTS

| | | | |
|---|---|---|---|
| JP | 2008214722 | A | 9/2008 |
| JP | 2008264828 | A | 11/2008 |
| TW | 201029776 | A | 8/2010 |
| WO | WO 0079015 | A1 | 12/2000 |
| WO | 2010044740 | A1 | 4/2010 |
| WO | 2010051943 | A1 | 5/2010 |
| WO | 2013167628 | A1 | 11/2013 |

OTHER PUBLICATIONS

International Preliminary Report on Patentability dated Feb. 15, 2016, for International Patent Application No. PCT/SE2015/050428.

Russian Office Action dated Oct. 23, 2018, for Russian Patent Application No. 2016136909/02(057993).

Chinese Office Action dated Jul. 24, 2018, for Chinese Patent Application No. 201580018983.4.

Taiwanese Office Action dated Aug. 16, 2018, for Taiwan Patent Application No. 104111762.

Australian Office Action dated Oct. 12, 2018, for Australian Patent Application No. 2015246667.

Indonesian Office Action dated Apr. 22, 2019, for Indonesian Patent Application No. P00201606882.

Russian Office Action dated Feb. 21, 2019, for Russian Patent Application No. 2016136909/02(057993).

Brazilian Office Action dated Aug. 8, 2019, for Brazilian Patent Application No. BR112016023887-7.

Japanese Office Action dated Aug. 27, 2019, for Japanese Patent Application No. 2018-108393.

* cited by examiner

COLD WORK TOOL STEEL

TECHNICAL FIELD

The invention relates to a cold work tool steel.

BACKGROUND OF THE INVENTION

Vanadium alloyed powder metallurgy (PM) tool steels have been on market for decades and attained a considerable interest because of the fact that they combine a high wear resistance with an excellent dimensional stability and because they have a good toughness. These steels have a wide rang of applications such as for knives, punches and dies for blanking, piercing and cold extrusion. The steels are produced by powder metallurgy. The basic steel composition is firstly atomized and thereafter the powder is filled into a capsule and subjected to hot isostatic pressing (HIP) in order to produce an isotropic steel. The performance of the steels tends to increase with increasing content of vanadium. A high performance steel produced in this way is CPM®10V. It has high carbon and vanadium contents as described in U.S. Pat. No. 4,249,945. Another steel of this kind is disclosed in EP 1 382 704 A1.

Although the known (PM) steel has a higher toughness than conventionally produced tool steels, there is a need for further improvements in order to reduce the risk for tool breakage, such as chipping and fracture and to further improve the machinability. Until now the standard measure to counteract chipping is to reduce the hardness of the tool.

DISCLOSURE OF THE INVENTION

The object of the present invention is to provide a powder metallurgy (PM) produced cold work tool steel having an improved property profile leading to an increased life time of the tool.

Another object of the present invention is to optimize the properties, while still maintaining a good wear resistance and at the same time improve the machinability.

A particular object is to provide a martensitic cold work tools steel alloy having an improved property profile for cold working.

The foregoing objects, as well as additional advantages are achieved to a significant measure by providing a cold work tool steel having a composition as set forth herein.

In one contemplated embodiment, the present invention provides a powder metallurgy produced tool steel for cold working consisting of, in weight %: C, 2.2-2.4; Si, 0.1-0.55; Mn, 0.2-0.8; Cr, 4.1-5.1; Mo, 3.1-4.5; and V, 7.2-8.5. Optionally, the steel may include one or more of: N, 0.02-0.15; P, ≤0.05; S, ≤0.5; Cu, ≤3; Co, ≤5; Ni, ≤3; W, ≤2; Nb, ≤2; Al, ≤0.1; Ti, ≤0.1; Zr, ≤0.1; Ta, ≤0.1; B, ≤0.6; Be, ≤0.2; Bi, ≤0.2; Se, ≤0.3; Ca, 0.0003-0.009; O, 0.003-0.01; Mg, ≤0.01; and REM ≤0.2. The balance of the composition includes Fe apart from impurities.

In another contemplated embodiment, the steel fulfills at least one of the following requirements: C, 2.25-2.35; Si, 0.2-0.5; Mn, 0.2-0.6; Cr, 4.5-5.0; Mo, 3.5-3.7; V, 7.7-8.3; N, 0.02-0.08; P, ≤0.03; S, ≤0.03; Cu, 0.02-2; Co, ≤1; Ni, ≤1; W, ≤0.3; Nb, ≤0.5; Al, ≤0.06; Ti, ≤0.01; Zr, ≤0.01; Ta, ≤0.01; B, ≤0.01; Be, ≤0.02; Se, ≤0.03; and Mg, ≤0.001.

Still further, it is contemplated that the steel fulfills at least one of the following requirements: C, 2.26-2.34; Si, 0.22-0.52; Mn, 0.22-0.52; Cr, 4.58-4.98; Mo, 3.51-3.69; V, 7.75-8.25; Cu, ≤0.5; and Ni, ≤0.3.

One additional steel is contemplated to consist of: C, 2.2-2.4; Si, 0.1-0.55; Mn, 0.2-0.8; Cr, 4.1-5.1; Mo, 3.1-4.5; V, 7.2-8.5; and N, 0.02-0.08; with the balance being Fe apart from impurities.

Still further, the steel may be made to fulfill at least one of the following requirements: C, 2.26-2.34; Si, 0.22-0.52; Mn, 0.22-0.52; Cr, 4.58-4.98; Mo, 3.51-3.69; V, 7.75-8.25; and N, 0.03-0.06.

Separately, the steel may be made to fulfill all of the following requirements: C, 2.26-2.34; Si, 0.22-0.52; Mn, 0.22-0.52; Cr, 4.58-4.98; Mo, 3.51-3.69; and V, 7.75-8.25.

The steel may be made such that the content of Mo and V fulfil the requirement: Mo/V, 0.4-0.5.

In another contemplated embodiment, the steel may have an unnotched impact toughness in the LT direction at 25° C. of 30-80 J at a hardness of 60 HRC in the hardened and tempered condition.

Still further, the steel may have a compression yield strength of at least 2400 MPa at 60 HRC.

Alternatively, the steel may have a content where Mo and V fulfil the requirement: Mo/V, 0.42-0.48.

The steel may have an unnotched impact toughness in the LT direction at 25° C. of 35-55 J, at a hardness of 60 HRC in the hardened and tempered condition.

DETAILED DESCRIPTION

The importance of the separate elements and their interaction with each other as well as the limitations of the chemical ingredients of the alloy of the present invention are briefly explained in the following. All percentages for the chemical composition of the steel are given in weight % (wt. %) throughout the description.

Carbon (2.2-2.4%)

Carbon is to be present in a minimum content of 2.2%, preferably at least 2.25%. The upper limit for carbon may be set to 2.4% or 2.35%. Preferred ranges are 2.25-2.35% and 2.26-2.34%. In any case, the amount of carbon should be controlled such that the amount of carbides of the type $M_{23}C_6$ and $M_7C_3$ in the steel is limited to less than 5 vol. %, preferably the steel is free from said carbides.

Chromium (4.1-5.1%)

Chromium is to be present in a content of at least 4.1% in order to provide a good hardenability in larger cross sections during heat treatment. If the chromium content is too high, this may lead to the formation of high-temperature ferrite, which reduces the hot-workability. The chromium content is therefore preferably 4.5-5.0%. The lower limit may be 4.2%, 4.3%, 4.4% or 4.5%. The upper limit may be 5.1%, 5.0%, 4.9% or 4.8%.

Molybdenum (3.1-4.5%)

Mo is known to have a very favourable effect on the hardenability. Molybdenum is essential for attaining a good secondary hardening response. The minimum content is 3.1%, and may be set to 3.2%, 3.3%, 3.4% or 3.5%. Molybdenum is a strong carbide forming element and also a strong ferrite former. The maximum content of molybdenum is therefore 4.5%. Preferably Mo is limited to 4.2%, 3.9% or even 3.7%.

Tungsten (≤2%)

In principle, molybdenum may be replaced by twice as much tungsten. However, tungsten is expensive and it also complicates the handling of scrap metal. The maximum amount is therefore limited to 2%, preferably 1%, more preferably 0.3% and most preferably no deliberate additions are made.

Vanadium (7.2-8.5%)

Vanadium forms evenly distributed primary precipitated carbides and carbonitrides of the type M(C,N) in the matrix of the steel. In the present steels M is mainly vanadium but significant amounts of Cr and Mo may be present. Vanadium shall therefore be present in an amount of 7.2-8.5. The upper limit may be set to 8.4%, 8.3%, or 8.25%. The lower limit may be 7.3%, 7.4%, 7.5%, 7.6%, 7.7%, 7.75%, and 7.8%. The upper and lower limits may be freely combined within the limits set out in claim 1 herein. Preferred ranges include 7.7-8.3%.

Nitrogen (0.02-0.15%)

Nitrogen may optionally be introduced in the steel in an amount of 0.02-0.15%, preferably 0.02-0.08% or 0.03-0.06%. Nitrogen helps to stabilize the M(C,N) because the thermal stability of vanadium carbonitrides is better than that of vanadium carbides.

Niobium (≤2%)

Niobium is similar to vanadium in that it forms carbonitrides of the type M(C,N) and may in principle be used to replace vanadium but that requires the double amount of niobium as compared to vanadium. Hence, the maximum addition of Nb is 2.0%. The combined amount of (V+Nb/2) should be 7.2-8.5%. However, Nb results in a more angular shape of the M(C,N). The preferred maximum amount is therefore 0.5%. Preferably, no niobium is added.

Silicon (0.1-0.55%)

Silicon is used for deoxidation. Si is present in the steel in a dissolved form. Si increases the carbon activity and is beneficial for the machinability. Si is therefore present in an amount of 0.1-0.55%. For a good deoxidation, it is preferred to adjust the Si content to at least 0.2%. Si is a strong ferrite former and should preferably be limited to ≤0.5%.

Manganese (0.2-0.8%)

Manganese contributes to improving the hardenability of the steel and together with sulphur manganese contributes to improving the machinability by forming manganese sulphides. Manganese shall therefore be present in a minimum content of 0.2%, preferably at least 0.22%. At higher sulphur contents manganese prevents red brittleness in the steel. The steel shall contain maximum 0.8%, preferably maximum 0.6%. Preferred ranges are 0.22-0.52%, 0.3-0.4 and 0.30-0.45%.

Nickel (≤3.0%)

Nickel is optional and may be present in an amount of up to 3%. It gives the steel a good hardenability and toughness. Because of the expense, the nickel content of the steel should be limited as far as possible. Accordingly, the Ni content is limited to 1%, preferably 0.3%. Most preferably, no nickel additions are made.

Copper (≤3.0%)

Cu is an optional element, which may contribute to increasing the hardness and the corrosion resistance of the steel. If used, the preferred range is 0.02-2% and the most preferred range is 0.04-1.6%. However, it is not possible to extract copper from the steel once it has been added. This drastically makes the scrap handling more difficult. For this reason, copper is normally not deliberately added.

Cobalt (≤5%)

Co is an optional element. It contributes to increase the hardness of the martensite. The maximum amount is 5% and, if added, an effective amount is about 4 to 5%. However, for practical reasons such as scrap handling there is no deliberate addition of Co. A preferred maximum content is 1%.

Sulphur (≤0.5%)

S contributes to improving the machinability of the steel. At higher sulphur contents there is a risk for red brittleness. Moreover, a high sulphur content may have a negative effect on the fatigue properties of the steel. The steel shall therefore contain ≤0.5%, preferably ≤0.03%.

Phosphorus (≤0.05%)

P is an impurity element, which may cause temper brittleness. It is therefore limited to ≤0.05%.

Be, Bi, Se, Ca, Mg, O and REM (Rare Earth Metals)

These elements may be added to the steel in selected amounts in order to further improve the machinability, hot workability and/or weldability.

Boron (≤0.6%)

Substantial amounts of boron may optionally be used to assist in the formation of the hard phase MX. Lower amounts of B may be used in order to increase the hardness of the steel. The amount is then limited to 0.01%, preferably ≤0.004%. Generally, no boron additions are made.

Ti, Zr, Al and Ta

These elements are carbide formers and may be present in the alloy for altering the composition of the hard phases. However, normally none of these elements are added.

Steel Production

The tool steel of the present invention can be produced by conventional gas atomizing. Normally the steel is subjected to hardening and tempering before being used.

Austenitizing may be performed at an austenitizing temperature ($T_A$) in the range of 950-1200° C., typically 1000-1100° C. A typical treatment is hardening at 1020° C. for 30 minutes, gas quenching and tempering at 550° C. for 2×2 hours. This results in a hardness of 59-61 HRC.

EXAMPLE

In this example, a steel according to the invention is compared to the known steel CPM®10V. Both steels were produced by powder metallurgy.

The basic steel composition was melted and subjected to gas atomization.

The steels thus obtained had the following composition (in wt. %):

| | Inventive steel | CPM ® 10V |
|---|---|---|
| C | 2.3 | 2.4 |
| Si | 0.37 | 0.89 |
| Mn | 0.37 | 0.45 |
| Cr | 4.78 | 5.25 |
| Mo | 3.6 | 1.26 |
| V | 8.0 | 9.85 |
| Mo/V | 0.45 | 0.13 |

balance iron and impurities.

The steel were austenitized at 1100° C. for 30 minutes, hardened by gas quenching and tempering twice at 540° C. for 2 hours (2×2 h) followed by air cooling. This results in a hardness of 63 HRC for both materials.

The composition of the matrix and the amount of primary MX at three different austenitizing temperatures were calculated in a Thermo-Calc simulation with the software version S-build-2532. The results are shown in Table 1.

TABLE 1

| | C | Si | Mn | Cr | Mo | V | MX (%) |
|---|---|---|---|---|---|---|---|
| Inventive steel | | | | | | | |
| 1020° C. | 0.43 | 0.43 | 0.42 | 4.6 | 1.54 | 0.39 | 15.8 |
| 1050° C. | 0.47 | 0.42 | 0.42 | 4.6 | 1.65 | 0.48 | 15.5 |
| 1080° C. | 0.52 | 0.42 | 0.42 | 4.7 | 1.76 | 0.59 | 15.2 |
| CPM ® 10V | | | | | | | |
| 1020° C. | 0.34 | 1 | 0.58 | 5.1 | 0.51 | 0.39 | 17.2 |
| 1050° C. | 0.38 | 1 | 0.58 | 5.1 | 0.54 | 0.48 | 17 |
| 1080° C. | 0.42 | 1 | 0.57 | 5.2 | 0.58 | 0.58 | 16.7 |

Table 1 reveals that the amount of hard phase in the inventive steel was only about 1.5% lower than the amount in the comparative steel. In addition, the simulation indicates that the matrix contained significantly higher amounts of carbon and molybdenum than in the comparative steel. Hence, an improved tempering response, as well as a higher hardness, are to be expected from this simulation. This was also confirmed by the calculated values, which indicated a higher hardness for the inventive steel. Moreover, the inventive steel is less sensitive to hardness decrease at high temperatures such that higher tempering temperatures can be used for removing retained austenite without impairing the hardness.

Surprisingly, it was found that the inventive steel also had a much better toughness. The un-notched impact energy in the transverse direction (e.g., the LT direction, which is also referred to as the longitudinal (or long) transverse direction) was 41 J as compared to 11 J for the comparative steel. The reason for this improvement is not fully clarified but it would appear that the low Si-content in combination with a high Mo-content improve the strength of the grain boundaries. Hence, the improved toughness of the inventive steel makes it possible to maintain a high hardness without problems with chipping and therefore improve the durability and lifetime of cold working tools.

Machinability Testing

Machinability is a complex topic and may be assessed by a number of different tests for different characteristics. The main characteristics are: tool life, limiting rate of material removal, cutting forces, machined surface and chip breaking. In the present case the machinability of the hot work tool steel was examined by drilling.

The turning machinability test was carried out on a NC Lathe Oerlikon Boehringer VDF 180 C. The work-piece dimensions were Ø115×600 mm.

The V30-value was used to compare the machinability of the steels. The V30-value is specified as the cutting speed, which gives a flank wear of 0.3 mm after 30 minutes of turning. V30 is a standardized test method described in ISO 3685 from 1977. The turning operation was performed at three different cutting speeds until the flank wear of 0.3 mm. The flank wear was measured using light optical microscope. The time to reach the 0.3 mm flank wear was noted. Using values of cutting speeds and the corresponding turning times, the Taylor double logarithmic graph-time versus cutting speed $V \times T^{\alpha}$=constant was plotted, from which it was possible to estimate the cutting speed for the required tool life of 30 minutes. The turning machinability test was carried out without cooling using a Coromant S4 SPGN 120304 hard metal insert, a feed of 0.126 mm/revolution and a cutting depth of 1.0 mm.

The inventive steel, which had a V30-value of 51 m/min, was found to perform better than the comparative steel, which only had a V30-value of 39 m/min.

INDUSTRIAL APPLICABILITY

The cold work tool steel of the present invention is particular useful in applications requiring good wear resistance in combination with a high resistance chipping.

The invention claimed is:

1. A powder metallurgy produced tool steel for cold working consisting of, in weight %:

| | |
|---|---|
| C | 2.2-2.4 |
| Si | 0.1-0.55 |
| Mn | 0.2-0.8 |
| Cr | 4.1-5.1 |
| Mo | 3.1-4.5 |
| V | 7.2-8.5 |
| W | ≤0.3 |

optionally one or more of

| | |
|---|---|
| N | 0.02-0.15 |
| P | ≤0.05 |
| S | ≤0.5 |
| Cu | ≤3 |
| Co | ≤5 |
| Ni | ≤3 |
| Nb | ≤2 |
| Al | ≤0.1 |
| Ti | ≤0.1 |
| Zr | ≤0.1 |
| Ta | ≤0.1 |
| B | ≤0.6 |
| Be | ≤0.2 |
| Bi | ≤0.2 |
| Se | ≤0.3 |
| Ca | 0.0003-0.009 |
| O | 0.003-0.01 |
| Mg | ≤0.01 |
| REM | ≤0.2, and |

balance Fe apart from impurities, wherein the tool steel has an unnotched impact toughness in the transverse direction at 25° C. of 30-80 J at a hardness of 60 HRC in the hardened and tempered condition.

2. The steel according to claim 1, fulfilling at least one of the following requirements:

| | |
|---|---|
| C | 2.25-2.35 |
| Si | 0.2-0.5 |
| Mn | 0.2-0.6 |
| Cr | 4.5-5.0 |
| Mo | 3.5-3.7 |
| V | 7.7-8.3 |
| N | 0.02-0.08 |
| P | ≤0.03 |
| S | ≤0.03 |
| Cu | 0.02-2 |
| Co | ≤1 |
| Ni | ≤1 |
| Nb | ≤0.5 |
| Al | ≤0.06 |
| Ti | ≤0.01 |
| Zr | ≤0.01 |
| Ta | ≤0.01 |
| B | ≤0.01 |
| Be | ≤0.02 |
| Se | ≤0.03, and |
| Mg | ≤0.001. |

3. The steel according to claim 1, fulfilling at least one of the following requirements:

| | |
|---|---|
| C | 2.26-2.34 |
| Si | 0.22-0.52 |
| Mn | 0.22-0.52 |
| Cr | 4.58-4.98 |
| Mo | 3.51-3.69 |
| V | 7.75-8.25 |
| Cu | ≤0.5, and |
| Ni | ≤0.3. |

4. The steel according to claim 1, consisting of:

| | |
|---|---|
| C | 2.2-2.4 |
| Si | 0.1-0.55 |
| Mn | 0.2-0.8 |
| Cr | 4.1-5.1 |
| Mo | 3.1-4.5 |
| V | 7.2-8.5 |
| N | 0.02-0.08, and |
| | balance Fe apart from impurities. |

5. The steel according to claim 1, fulfilling at least one of the following requirements:

| | |
|---|---|
| C | 2.26-2.34 |
| Si | 0.22-0.52 |
| Mn | 0.22-0.52 |
| Cr | 4.58-4.98 |
| Mo | 3.51-3.69 |
| V | 7.75-8.25, and |
| N | 0.03-0.06. |

6. The steel according to claim 1, fulfilling all of the following requirements:

| | |
|---|---|
| C | 2.26-2.34 |
| Si | 0.22-0.52 |
| Mn | 0.22-0.52 |
| Cr | 4.58-4.98 |
| Mo | 3.51-3.69, and |
| V | 7.75-8.25. |

7. The steel according to claim 1, wherein the content of Mo and V fulfil the requirement:

| | |
|---|---|
| Mo/V | 0.4-0.5. |

8. The steel according to claim 1, having a compression yield strength of at least 2400 MPa at 60 HRC.

9. The steel according to claim 7, wherein the content of Mo and V fulfil the requirement:

| | |
|---|---|
| Mo/V | 0.42-0.48. |

10. The steel according to claim 1, having an unnotched impact toughness in the transverse direction at 25° C. of 35-55 J, at a hardness of 60 HRC in the hardened and tempered condition.

* * * * *